United States Patent [19]

Aoki

[11] 4,327,622

[45] May 4, 1982

[54] ELECTRONIC MUSICAL INSTRUMENT REALIZING AUTOMATIC PERFORMANCE BY MEMORIZED PROGRESSION

[75] Inventor: Eiichiro Aoki, Hamamatsu, Japan

[73] Assignee: Nippon Gakki Seizo Kabushiki Kaisha, Hamamatsu, Japan

[21] Appl. No.: 161,582

[22] Filed: Jun. 20, 1980

[30] Foreign Application Priority Data

Jun. 25, 1979 [JP] Japan ..... 54-79918

[51] Int. Cl.[3] ..... G10H 1/38; G10H 1/42

[52] U.S. Cl. ..... 84/1.03; 84/DIG. 12; 84/DIG. 22

[58] Field of Search ..... 84/1.01, 1.03, 1.17, 84/1.24, DIG. 12, DIG. 22

[56] References Cited

U.S. PATENT DOCUMENTS

| | | | |
|---|---|---|---|
| Re. 29,144 | 3/1977 | Bunger | 84/1.01 |
| 3,844,192 | 10/1974 | Brand et al. | 84/1.01 |
| 3,872,765 | 3/1975 | Amaya | 84/1.01 |
| 3,889,568 | 6/1975 | Amaya | 84/1.01 |
| 4,065,993 | 1/1978 | Hirose | 84/1.03 |
| 4,282,786 | 8/1981 | Deutsch et al. | 84/1.01 |

*Primary Examiner*—S. J. Witkowski

*Attorney, Agent, or Firm*—Spensley, Horn, Jubas & Lubitz

[57] ABSTRACT

An electronic musical instrument is of a type in which bass/chord performance can be automatically performed without depression of the keys on the keyboard. This electronic musical instrument has a chord constituent note data producing circuit which stores several kinds of chord progression patterns each of which consists of a series of plural chord data aligned in sequence. The chord progression pattern to be played is selected by the chord progression designation switch. The chord note data producing circuit has a memory for storing a root note of each chord as the chord data, and circuit for producing subordinate note data based on the chord data and tonality for the chord. Data for bass tone is obtained by a root note detection circuit for producing a root note data, a pattern producing circuit for producing bass pattern data, and an adder for adding the root note data and the bass pattern data.

7 Claims, 7 Drawing Figures

32
44
48
45
43
31
49
Q5
Q4'
46
Q4
DEGREE DATA
TO ADDER 33, 34 AND DECODER 37
Q3'
Q3
ADDER
51
50
Q2'
Q2
47
Q1'
Q1
DATA CONVERTER
TONALITY DATA

FIG. 5
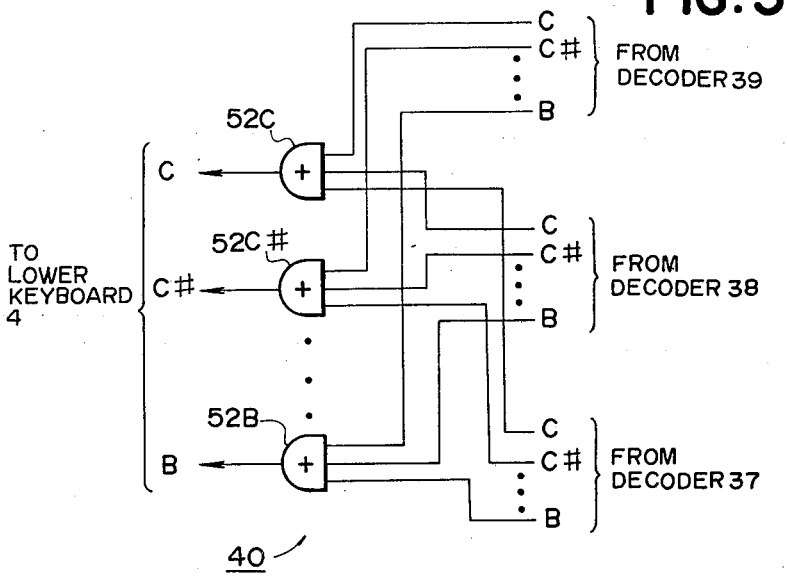
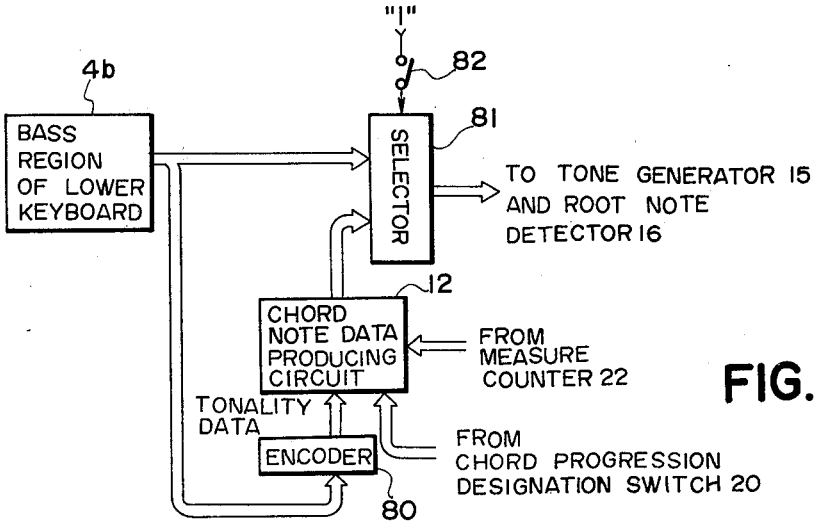
FIG. 7

ELECTRONIC MUSICAL INSTRUMENT REALIZING AUTOMATIC PERFORMANCE BY MEMORIZED PROGRESSION

BACKGROUND OF THE INVENTION

This invention relates to an electronic musical instrument equipped with an automatic bass/chord performance function.

An automatic bass/chord performance function by which bass tones and chord tones are produced automatically in accordance with a predetermined rhythm pattern by depressing the keys corresponding to the desired chord in a keyboard for chord performance (such as a lower keyboard), is well known in the art. In this kind of electronic musical instrument equipped with an automatic bass/chord performance function, the player must manage the chord progression (changes of chords according to measures) by playing the lower keyboard with his left hand. If the chord progression can be done automatically, the player does not need to use his left hand for the chord progression. Thus, all the players have to do is to play the melody. Accordingly, easy playing is available to all players, especially to beginners.

SUMMARY OF THE INVENTION

Accordingly, an object of this invention is to provide an electronic musical instrument which performs automatically the chord progression in automatic bass/-chord performance function.

According to this invention, a plurality of chords are stored in advance and stored chords are read out in accordance with progression of music for an automatic bass performance and an automatic chord performance.

BRIEF DESCRIPTION OF THE DRAWINGS

In the accompanying drawings:

FIG. 5 is a block diagram of the OR circuit group in FIG. 3;

FIG. 7 is a block diagram showing only changed portion in another example according to this invention.

DETAILED DESCRIPTION OF THE INVENTION

Figure 1:
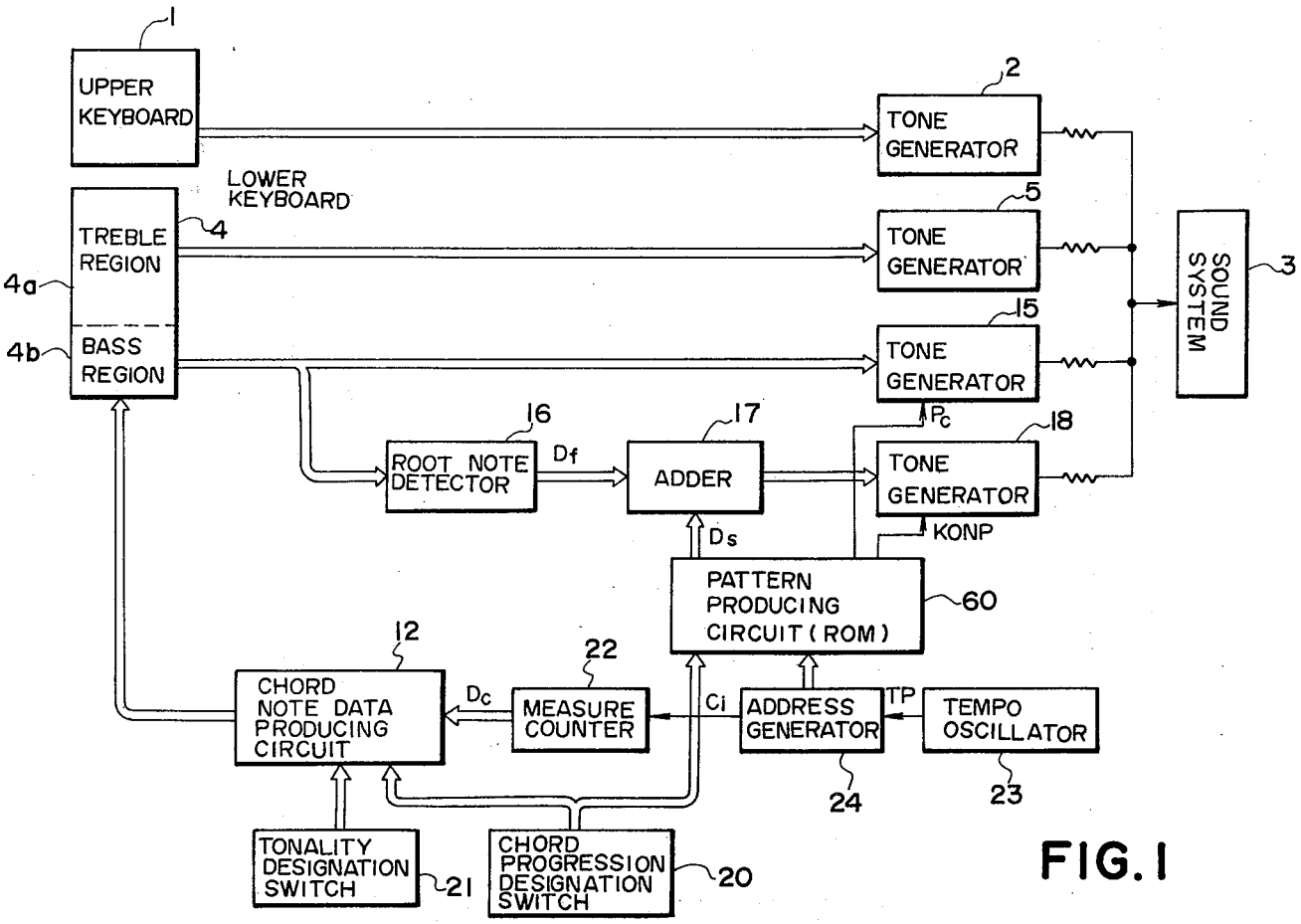
FIG. 1 is a block diagram indicating the example of the automatic performance device according to this invention.

The embodiment shown in FIG. 1 is arranged such that chord progression in the automatic bass/chord performance is realized either automatically or manually.

In FIG. 1, the upper keyboard 1 is for playing melodies and not related to the automatic bass/chord performance function. The signals corresponding to the depressed keys are delivered from the upper keyboard 1 and applied to a tone generator 2. In the tone generator 2, musical tone signals of frequencies corresponding to the respective pitches of the depressed keys are produced and then a suitable tone color (for example, a flute tone color) is given to the musical tone signals. These musical tone signals outputted from the tone generator 2 are applied to sound system 3, where the tones are sounded audibly.

The lower keyboard 4 is for playing melodies and conducting chord progression in the automatic bass/-chord performance. In this embodiment, the lower keyboard 4 is divided into two regions: treble (higher side) region 4*a* and bass region (lower side) 4*b*. The treble region 4*a* is used to play melodies, while the bass region 4*b* is used for chord performance. The treble region 4*a* delivers, in the same way as the upper keyboard, signals corresponding to the depressed keys, and these signals are applied to the tone generator 5. Then, based on these signals, the tone generator 5 produces musical tone signals of frequencies corresponding to the respective notes of the depressed keys, and a suitable tone color (for example, a string tone color) is given to these musical tone signals. These signals are sent to sound system 3 and then sounded audibly.

Figure 2:
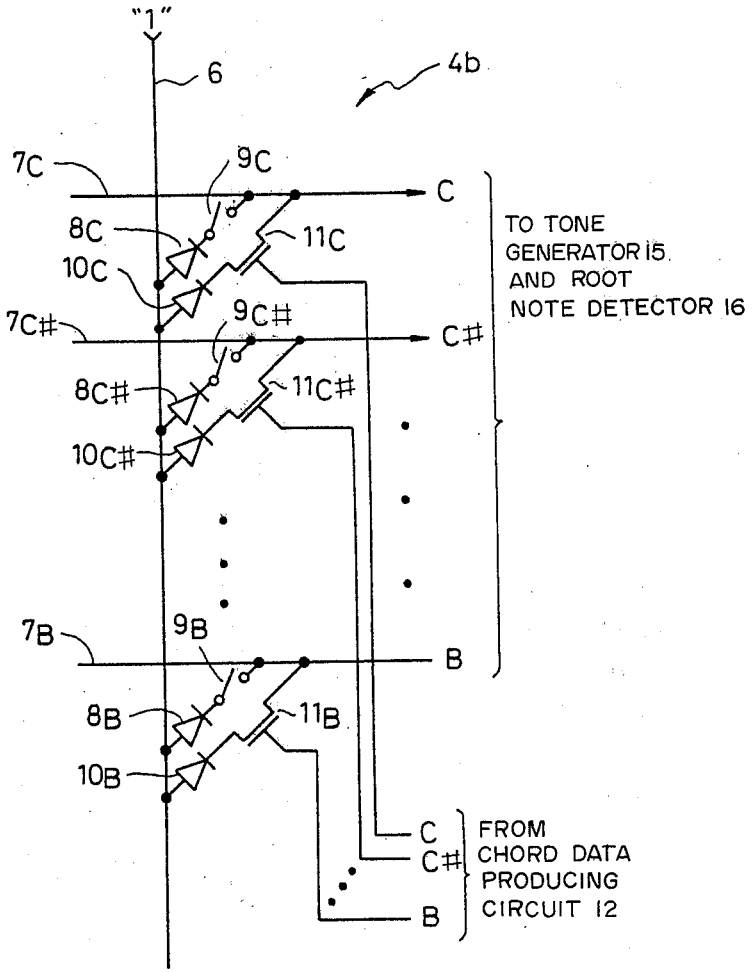
FIG. 2 is a circuit showing the detail of the bass region of the lower keyboard in FIG. 1.

The bass region 4*b* of the lower keyboard 4 is the section conducting chord performance. It delivers out signals which indicate notes constituting a chord (hereinafter called chord constituent notes) automatically or by manual operation. In other words, as is shown in FIG. 2, the bass region 4*b* is provided with a power source line 6 which is supplied with signal "1"; output lines 7C, 7C♯, . . . , 7B which correspond to respective musical notes (C, C♯, . . . , B); diodes 8C, 8C♯, . . . , 8B which are connected between the power source line 6 and the output lines 7C, 7C♯, . . . , 7B; and key switches 9C, 9C♯, . . . , 9B which are turned on when the respective associated keys are depressed. Signal "1" is applied to the output line (among 7C, 7C♯, . . . , 7B) which corresponds to the note of the key which is being depressed in this bass region. Furthermore, in parallel to the circuits respectively having the above-mentioned diodes 8C, 8C♯, . . . 8B and switches 9C, 9C♯, . . . , 9B, there are respectively connected circuits respectively provided with diodes 10C, 10C♯, . . . , 10B and gates 11C, 11C♯, . . . , 11B (for example, FET gates). These latter circuits are connected between the power source line 6 and the output lines 7C, 7C♯, . . . , 7B, respectively. Here, the gates 11C, 11C♯, . . . , 11B are turned on in response to the outputs (signals which represent chord constituent notes in the automatic chord progression) of a chord note data producing circuit 12 as described later, and the signal "1" is produced on the output lines (among 7C, 7C♯, . . . , 7B) corresponding to the chord constituent notes in the automatic chord progression.

The signals, which indicate the chord constituent notes, are outputted from the bass region 4*b* and applied to the tone generator 15 in FIG. 1. In this tone generator 15, musical tone signals having frequencies corresponding to the chord constituent notes are produced respectively and a suitable tone color (for example, the tone color of a brass instrument) is given to these tone signals. Then the timings of the tone production are controlled by a beating pulse PC as described later and then the signals are led to the sound system 3. In this way, the chord tones are sounded from the sound system 3. Furthermore, the signals which represent the chord constituent notes and are delivered from the bass region 4*b* are simultaneously applied to the root note detector circuit 16 wherein the root note of the chord being depressed is detected. When the root note is detected, a data Df indicating the root note is applied to an adder 17. Then bass pattern data Ds which are produced by a pattern producing circuit 60 as described later, are added to the data Df which indicates the above root tone, by the adder 17 to produce root note data, which in turn is applied to the tone generator 18. Here a brief explanation about the bass pattern data Ds is made.

In automatic bass performance, the chord constituent notes are generally produced one at a time and one after another as bass tones in accordance with the desired rhythm. In order to produce also the tones of the notes other than the root note (hereinafter referred to as subordinate notes) among the chord constituent notes, as the bass tones, these subordinate notes must be formed based on the root note. The data for also generating subordinate notes are the bass pattern data Ds. The bass pattern data Ds are the data which indicate which one from among the chord constituent notes should be generated at respective tone production timings of the bass tones. Therefore, the data Ds indicate numerically the respective degrees of the chord constituent notes with respect to the root note.

At the tone generator 18, musical tone signals are generated on the basis of the inputted bass tone data, and tone color of the bass tones is given to the generated musical tone signals. Tone production timings of the musical tone signals are controlled in response to key-on pulses KONP as explained later and the signals are applied to the sound system 3 wherein bass tones are sounded audibly.

In FIG. 1, the chord note data producing circuit 12 is a circuit provided with a memory which stores several kinds of chord progression patterns. A chord progression designation switch 20 is a switch which permits the player to select one chord progression pattern from among said several kinds of chord progression patterns. When the signal generated according to the operation of that switch 20 is applied to the chord note data producing circuit 12 as an address signal, the addressed chord progression pattern is read out. A tonality designation switch 21 is a switch which selectively designates the tonality of the chord tones to be produced in accordance with the selected chord progression. In other words, in this example, in order to lessen the capacity of the memory which stores the chord progression patterns, the chord name data (for example, C, Am, $G_7$, etc.) are not stored just as they are, but the data (hereinafter called chord degree data) is stored in a form such that the tonality is not included in the chord name data. Then the tonality is added to the chord degree data in forming the chord note data. Here, the chord degree data is such a data (for example, I, IIm, $V_7$ (a symbol which has no suffix indicates a major triad)) that is obtained by combining the data (for example, the first degree (I), the second degree (II), the fifth degree (V)) (hereinafter called degree data) which shows the degree of the root note of the chord in the musical scale of the performed tonality and the data (for example, major triad (M), minor triad (m), dominant seventh (7), etc.) (hereinafter called chord type data) which shows the chord type. It should be noted that a term "tonality" is used to mean a note name or "key" in this specification to prevent confusion with a key in a keyboard. The chord degree represents the position in the musical scale of the chord root note with respect to a particular, separately designated tonality or note name.

Concretely speaking, the addition of the tonality to the above noted chord degree data is performed as shown below. Firstly, the chord progression pattern which is stored in the memory 30 is in the chord degree data form such as, for example.

$$I \rightarrow VIm \rightarrow IIm \rightarrow V_7.$$

Then, with respect to the chord progression pattern, when the tonality of C is designated, each of the chord degree data I, VI, II, V now corresponds to the chord of C, the chord of A, the chord of D and the chord of G respectively so that the chord note data are outputted from the chord note data producing circuit 12 in the chord progression pattern of $C \rightarrow Am \rightarrow Dm \rightarrow G_7$.

A measure counter 22 reads out respective chord note data, measure by measure, from the chord note data producing circuit 12, according to the above noted chord progression pattern. This measure counter 22 is driven based on the tempo pulse TP from the tempo oscillator 23. In other words, the tempo oscillator 23 generates the tempo pulse TP having a predetermined period and supplies the pulse to an address generator 24. The address generator 24 counts this tempo pulse TP and produces one pulse Ci (measure pulse) every time the counter value reaches a number equivalent to the time length of one measure. In the measure counter 22, this measure pulse Ci is counted and count value thereof is outputted as data Dc (measure number data) showing the number of measures. The measure number data Dc is supplied to the chord note data producing circuit 12 as an address signal so that the chord degree data of the designated chord progression pattern are read out sequentially, measure by measure.

Figure 3:
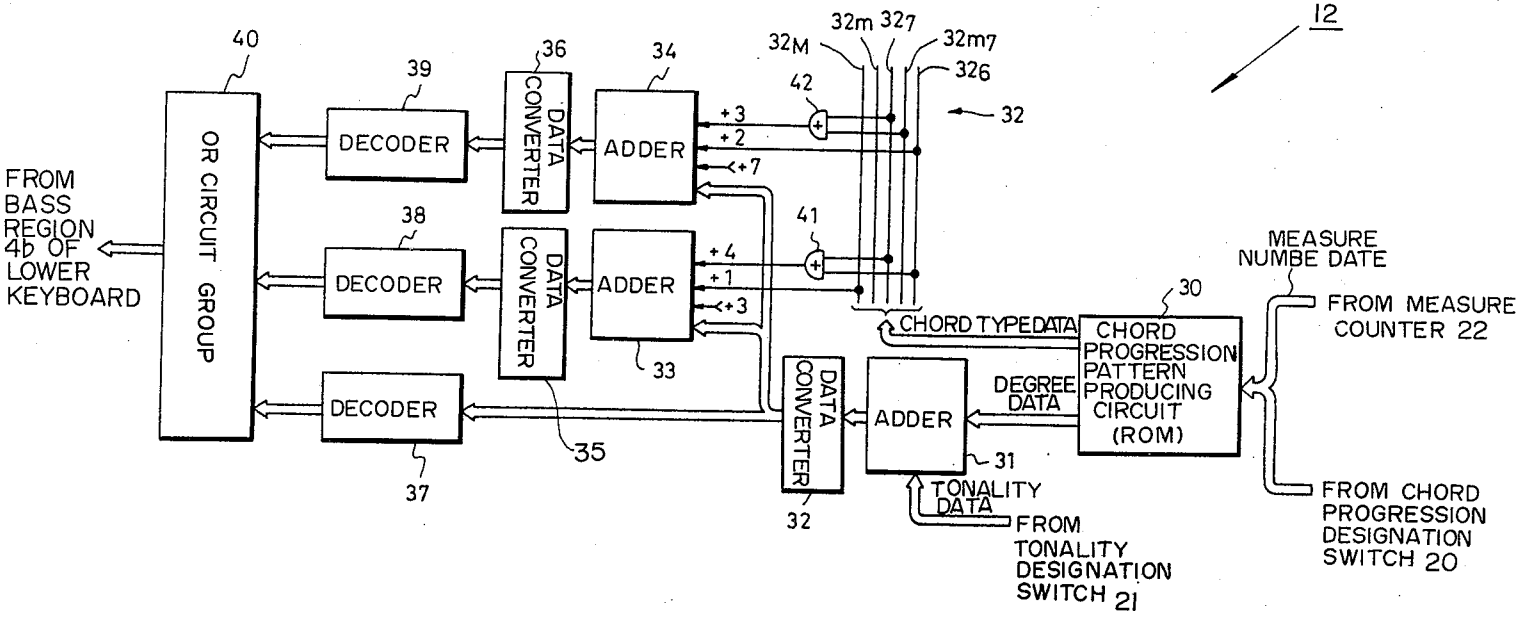
FIG. 3 is a block diagram showing the detail of the chord tone data producing circuit in FIG. 1.

The detailed example of the chord note data producing circuit 12 is shown in FIG. 3.

In FIG. 3, a chord progression pattern producing circuit 30 is a memory circuit (ROM) which stores various progression patterns

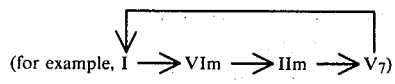

of sequential combination of the chord degree data. In this chord progression pattern producing circuit 30, one chord progression pattern is designated according to the operation of the chord progression designating switch 20. Each chord degree data of the designated chord progression pattern is read out based on the measure number data Dc at every one measure.

The chord degree data is, as explained earlier, the data which includes degree data and chord type data, and in the circuit 30, these degree data and chord type data are outputted on separate lines. In this example, there are 5 types of chord: major triad (M), minor triad (m), dominant seventh (7), minor seventh (m7) and major sixth (6), and a corresponding output line 32 (32M, 32m, 32$_7$, 32m$_7$, 32$_6$) is provided for each chord type. Therefore, signal 1 is outputted to the output line which corresponds to the chord type from the circuit 30. The degree data is as shown in Table 1.

TABLE 1

| Degree | Degree data |
|---|---|
| VII | 1011 |
| VI# | 1010 |
| VI | 1001 |

TABLE 1-continued

| Degree | Degree data |
|---|---|
| V# | 1000 |
| V | 0111 |
| IV# | 0110 |
| IV | 0101 |
| III | 0100 |
| II# | 0011 |
| II | 0010 |
| I# | 0001 |
| I | 0000 |

The adder 31 changes the degree data outputted from the circuit 30 into data of the note name according to the tonality designated by the tonality designation switch 21. In this embodiment, the data (hereinafter called the tonality data) according to the tonality designated by the tonality designation switch 21 is produced and tonality data is added to the degree data, thus converting it into data representing the actual note name. The tonality data and also the note name data (i.e. a data which represents the note name) are such as shown in Table 2.

TABLE 2

| Tonality or Note Name | Tonality Data or Note Name Data |
|---|---|
| B | 1011 |
| A# | 1010 |
| A | 1001 |
| G# | 1000 |
| G | 0111 |
| F# | 0110 |
| F | 0101 |
| E | 0100 |
| D# | 0011 |
| D | 0010 |
| C# | 0001 |
| C | 0000 |

In the case that the note name data is determined as shown in Table 2, the output data of adder 31 for each degree and the note names corresponding to output data are as shown in the column ⓐ of Table 3 when the tonality is designated as F (the tonality data is 0101).

TABLE 3

| | | ⓐ | | ⓑ | |
|---|---|---|---|---|---|
| Degree | (data) | Output data of adder 31 | (note name) | Output data of converter 32 | (note name) |
| VII | (1011) | 10000 | (none) | 00100 | (E) |
| VI# | (1010) | 01111 | (none) | 00011 | (D#) |
| VI | (1001) | 01110 | (none) | 00010 | (D) |
| V# | (1000) | 01101 | (none) | 00001 | (C#) |
| V | (0111) | 01100 | (none) | 00000 | (C) |
| IV# | (0110) | 01011 | (B) | 01011 | (B) |
| IV | (0101) | 01010 | (A#) | 01010 | (A#) |
| III | (0100) | 01001 | (A) | 01001 | (A) |
| II# | (0011) | 01000 | (G#) | 01000 | (G#) |
| II | (0010) | 00111 | (G) | 00111 | (G) |
| I# | (0001) | 00110 | (F#) | 00110 | (F#) |
| I | (0000) | 00101 | (F) | 00101 | (F) |

As in the above, adder 31 converts the degree data into note name data for the designated tonality. However, it can be seen from column ⓐ in Table 3 that there are some situations where the output of the adder 31 does not correspond to any of note name. This is because the note name can be indicated by the number within the range from "0000(note C)" to "1011(note B)" but the sum value from the adder 31 may become above such a range. Accordingly, when the sum is "1100" or above, the value must be corrected into the correct note name data. In other words, since above the note B are repeated the note C, the note C#,..., B and over again, it is preferable that sum values "1100" and above are converted to data corresponding to the note of C, C#,..., B respectively.

In FIG. 3, the data converter 32 performs such a conversion of the data. Each of the conversions is such that the relation between the input data (the 5 bit data $Q_5\,Q_4\,Q_3\,Q_2\,Q_1$) and the output data (the 4 bit data $Q_4'\,Q_3'\,Q_2'\,Q_1'$) become as shown in Table 4.

TABLE 4

| Input data | | | | | (note | Output data | | | | (note |
|---|---|---|---|---|---|---|---|---|---|---|
| $Q_5$ | $Q_4$ | $Q_3$ | $Q_2$ | $Q_1$ | name) | $Q_4'$ | $Q_3'$ | $Q_2'$ | $Q_1'$ | name) |
| 1 | 0 | 1 | 1 | 0 | (none) | 1 | 0 | 1 | 0 | (A#) |
| 1 | 0 | 1 | 0 | 1 | (none) | 1 | 0 | 0 | 1 | (A) |
| 1 | 0 | 1 | 0 | 0 | (none) | 1 | 0 | 0 | 0 | (G#) |
| 1 | 0 | 0 | 1 | 1 | (none) | 0 | 1 | 1 | 1 | (G) |
| 1 | 0 | 0 | 1 | 0 | (none) | 0 | 1 | 1 | 0 | (F#) |
| 1 | 0 | 0 | 0 | 1 | (none) | 0 | 1 | 0 | 1 | (F) |
| 1 | 0 | 0 | 0 | 0 | (none) | 0 | 1 | 0 | 0 | (E) |
| 0 | 1 | 1 | 1 | 1 | (none) | 0 | 0 | 1 | 1 | (D#) |
| 0 | 1 | 1 | 1 | 0 | (none) | 0 | 0 | 1 | 0 | (D) |
| 0 | 1 | 1 | 0 | 1 | (none) | 0 | 0 | 0 | 1 | (C#) |
| 0 | 1 | 1 | 0 | 0 | (none) | 0 | 0 | 0 | 0 | (C) |
| 0 | 1 | 0 | 1 | 1 | (B) | 1 | 0 | 1 | 1 | (B) |
| 0 | 1 | 0 | 1 | 0 | (A#) | 1 | 0 | 1 | 0 | (A#) |
| 0 | 1 | 0 | 0 | 1 | (A) | 1 | 0 | 0 | 1 | (A) |
| 0 | 1 | 0 | 0 | 0 | (G#) | 1 | 0 | 0 | 0 | (G#) |
| 0 | 0 | 1 | 1 | 1 | (G) | 0 | 1 | 1 | 1 | (G) |
| 0 | 0 | 1 | 1 | 0 | (F#) | 0 | 1 | 1 | 0 | (F#) |
| 0 | 0 | 1 | 0 | 1 | (F) | 0 | 1 | 0 | 1 | (F) |
| 0 | 0 | 1 | 0 | 0 | (E) | 0 | 1 | 0 | 0 | (E) |
| 0 | 0 | 0 | 1 | 1 | (D#) | 0 | 0 | 1 | 1 | (D#) |
| 0 | 0 | 0 | 1 | 0 | (D) | 0 | 0 | 1 | 0 | (D) |
| 0 | 0 | 0 | 0 | 1 | (C#) | 0 | 0 | 0 | 1 | (C#) |
| 0 | 0 | 0 | 0 | 0 | (C) | 0 | 0 | 0 | 0 | (C) |

It will be understood from Table 4 that the data converter 32 performs the conversion according to value of the 3 bits of the input data $Q_5\,Q_4\,Q_3$. Concretely speaking, as is shown in Table 5, when the values of $Q_5\,Q_4\,Q_3$ before the conversion is "101", the values of $Q_4\,Q_3$ are inverted to become "10" and when the values of $Q_5\,Q_4\,Q_3$ are "100", the number "1" is set in $Q_3$ so that after conversion $Q_4'\,Q_3'$ become "01". When the values of $Q_4\,Q_3$ before conversion are "11", the values of $Q_4\,Q_3$ are reversed so that the values of $Q_4'\,Q_3'$ after conversion become "00". Besides the situations, the data is passed through as is without conversion.

TABLE 5

| Before conversion | | | After conversion | |
|---|---|---|---|---|
| $Q_5$ | $Q_4$ | $Q_3$ | $Q_4'$ | $Q_3'$ |
| 1 | 0 | 1 | 1 | 0 |
| 1 | 0 | 0 | 0 | 1 |
| | 1 | 1 | 0 | 0 |

Figure 4:
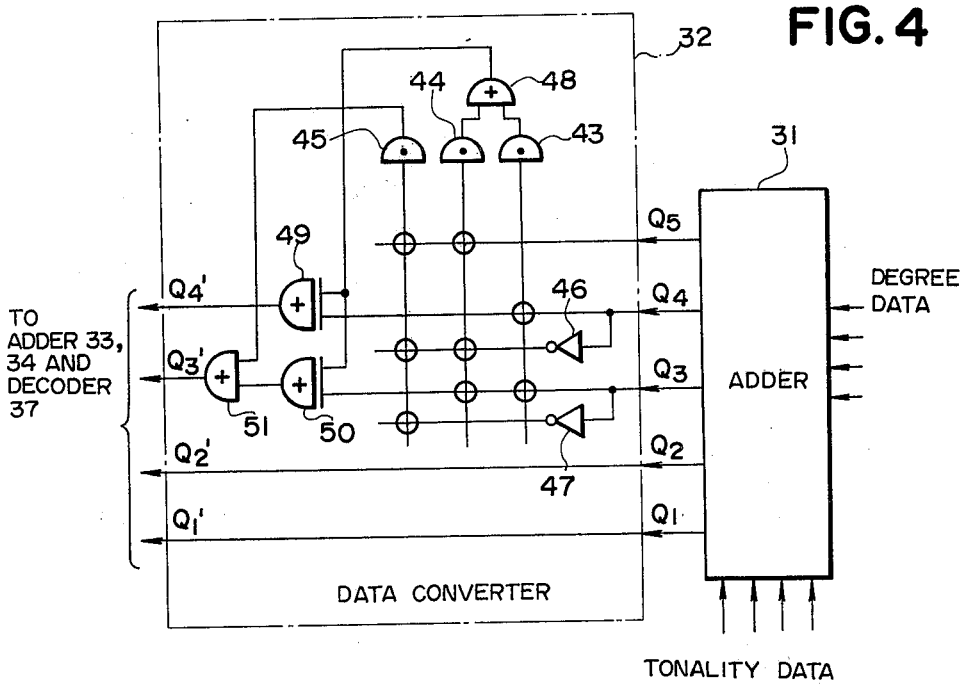
FIG. 4 is a block diagram showing the detail of the data converter in FIG. 3.

An example of data converter 32 which performs the conversion as shown above is shown in FIG. 4. In FIG. 4, the drawing of the input lines of the AND circuits 43, 44 and 45 has been simplified. This means that from among the bit outputs of the adder 31, the bit signals which are inputted to the adders 43, 44, 45 are shown with circles at the point of intersection with input lines of and the circuits 43, 44, 45. In other words, the input signals $Q_3$ and $Q_4$ are applied to the AND circuit 43, input signals $Q_5$, $Q_3$ and $\overline{Q_4}$ which is obtained by inverting $Q_4$ through the inverter 46 are applied to the AND circuit 44; and input $Q_5$ and input signals $\bar{Q}_4$ and $\bar{Q}_3$, which are obtained with the inversions of inputs $Q_4$ and $Q_3$ through the inverter 46, are added to the AND circuit 45. Then the output of the AND circuits 43 and 44 are collected at OR circuit 48 and are applied to one input of each of EXCLUSIVE OR circuits 49 and 50. To the other input of these EXCLUSIVE OR circuits 49 and 50, the outputs $Q_4$ and $Q_3$ of the adder 31 are applied respectively. The output of EXCLUSIVE OR circuit 49 is outputted from conversion device 32 as the output $Q_4'$ of the data converter 32 and the outputs of EXCLUSIVE OR circuit 50 and the AND circuit 45 outputted from converter 32 through an OR circuit 51 as output $Q_3'$. Accordingly, when the input $Q_5 Q_4 Q_3$ of the data converter 32 is "101", the output of the AND circuit 44 becomes "1" so that the output $Q_4' Q_3'$ becomes "10". When the output $Q_5 Q_4 Q_3$ is "100", the output of AND circuit 45 becomes "1" and is outputted through the OR circuit 51 so that the output $Q_4' Q_3'$ becomes "01". Furthermore, when the input $Q_4 Q_3$ is "11", the output of the AND circuit 43 becomes "1" so that the output $Q_4' Q_3'$ becomes "00". In the above way, the conversion shown in the Table 4 is performed. The data in column ⓑ in the Table 3 shows data obtained by converting data in column ⓐ in the Table 3 in the same way as above.

The data $(Q_4' - Q_1')$ which is outputted from the data conversion device 32, as the note name data representing the name of the root note of the chord tone, is applied to the decoder 37 (FIG. 3). Furthermore, this note name data is applied to the adder 33 and 34 and is used to form two subordinate notes. As the degrees of the subordinate notes are definite according to the type of chord (major triad (M), minor triad (m), dominant seventh (7) etc.), it is necessary that the value corresponding to the interval of each degree from the root is added to the note name data of the root note, in order to form the note name data of the subordinate notes based on the note name data of the root note. Table 6 shows relation between types of chord and the note degrees of the root note and two subordinate notes constituting a chord. In Table 6, the root notes are shown by O and the subordinate notes by Δ and □. The number which is written in parentheses next to the number showing the note degree is a number which shows how far the note is separated from the root note among the 12 notes C–B. When the subordinate notes are formed on the root note, these numbers are respectively added to the note name data of the root note.

TABLE 6

| Type of chord | Note degree | | | | | |
|---|---|---|---|---|---|---|
| | 1° | 3b° (3) | 3° (4) | 5° (7) | 6° (9) | 7b° (10) |
| major triad (M) | O | | Δ | □ | | |
| minor triad (m) | O | Δ | | □ | | |
| dominant seventh (7) | O | | | Δ | | □ |
| minor seventh (m7) | O | Δ | | | | □ |
| sixth (6) | O | | | Δ | □ | |

The adder 33 and 34 add each of the numbers representing the distances of the note degrees of the two subordinate notes from the root note (in other words, the numbers written in parentheses in the note degree column of Table 6) to the note name data of the root note to form the note name data of each of the two subordinate notes. Concerning the subordinate notes which are shown in Table 6 by Δ (hereinafter called the first subordinate note), since in this example they are notes being apart from the root note by a minor third interval or more (refer to Table 6), the adder 33 shown in FIG. 3 always adds +3 and the deficiencies are further added depending on the types of chord. For example, in the case of major triad (M), the degree of the first subordinate note is a major third and the number to be added is +4, and this is different from +3 by +1, the signal "+1" brought from the major output line 32M is added to the adder 32. In the same way, in the chords of dominant seventh (7) and sixth (6), the degree of the first subordinate note is a fifth and the number to be added is "7, and thus, as this is different from +3 by +4, a value "+4" is added to the adder 33 based on a "1" signal led through the OR circuit 41 from the output lines $32_7$ and $32_6$. In the cases of minor triad (m) or minor seventh (m7) chords, the degree of the first subordinate note is a minor third and the number to be added is +3, but as the difference with the +3 is 0, the "1" signal from the output lines 32m, $32m_7$ is not used for addition.

As the subordinate notes shown by □ in Table 6 (hereinafter the second subordinate notes) are notes being apart from the major root note by a fifth interval or more in this example, +7 is always added to the adder 34 and the deficiencies are further added, depending on the types of chord. For example, in the case of sixth (6), the degree of the second subordinate note is a major sixth and the number to be added is "9, but as the difference from +7 is +2, +2 is further added to the adder 34 based on the "1" signal from the sixth output line $32_6$. In the case of dominant seventh and minor seventh, the degree of the second subordinate note is minor seventh and the number to be added is +10, but as the difference from +7 is 3. This "3" is added to the adder 34 based on the signal "1" led through the OR circuit 42 from the previously mentioned output lines $32_7$ and $32m_7$. In the case of major triad (M) and minor triad (m) the degree of the second subordinate note is fifth and the number to be added is +7, but as the difference from +7 is 0, the "1" signals from the output lines 32M and 32m are not applied to the adder 34.

As in the above, the note name data indicating the first subordinate note and the second subordinate note are outputted from adders 33 and 34.

As there are cases where in the similar way as in the situation with respect to the adder 31, the sum values of the adders 33 and 34 do not correspond to the note names to which they are supposed to correspond, the data converters 35 and 36 designed in the same manner as the data converter 32, are utilized to convert the sum values to appropriate values.

The note name signals of the first and second subordinate notes outputted from the data converters 35 and 36 are decoded at decoders 38 and 39, and then are applied to an OR circuit group 40. The note name data of the root note outputted from the data converter 32 is decoded at decoder 37, and then is applied to the OR circuit group 40. The OR circuit group 40 is to deliver out the signals of the same note name in common among the output lines of decoders 37, 38, 39. For example, the OR circuit group 40 comprises a plurality of OR circuits 52C–52B to each input of which the output lines of the corresponding note names of the decoders 37, 38, 39 are connected as shown in FIG. 5.

The note name signals which indicate the chord constituent notes (the root note and the first and second subordinate notes) outputted from the OR circuit group 40, are applied to the gates 11C, 11C#, . . . , 11B (refer to FIG. 2) which are included in the bass region **4*b* of the lower keyboard 4, and a signal "1" is led to the output line (7C, 7C#, . . . 7B) corresponding to that note name. The signals which indicate the chord constitutent notes outputted from the bass region 4*b* are applied to the tone generator 15, wherein a suitable tone color (here a brass tone color) is imparted. Furthermore, after a suitable rhythm has been given based on the beating pulses PC which are outputted from pattern producing circuit 40, explained later, in correspondence with the production timing of the chord tones, the signals are directed to the sound system 3. In this way, in response to the output from the chord note data producing circuit 12, the chord tones are generated from the sound system 3**.

The signals which indicate the chord constituent notes outputted from the bass region **4*b* of the lower keyboard 4, are applied to the root note detector circuit 16 wherein the root note is detected. The data Df representing the detected root note is applied to the adder 17. The pattern producing circuit 60 is a circuit which stores the rhythm patterns of the bass tones. Based on the stored rhythm pattern, short pulses (key-on pulses) KONP are delivered out. For example, signals "1" are stored at positions of the memory corresponding to the tone production timings in accordance with the rhythm pattern, and thereafter are read out by an address signal from address generator 24**, and is shaped into a short pulse so that the key-on pulse KONP is obtainable.

The pattern producing circuit 60 also produces the bass pattern data Ds every time a key-on pulse KONP is generated. This data Ds is then applied to the adder 17 so as to modify the root note data outputted from the root note detector circuit 16. For example, where the chord constituent notes of the chords in the chord progression pattern selected by the chord progression designation switch 20, are produced one after another in one measure, it is advisable to do the following. Now, assume that, for example, from among the chords constituting the chord progression pattern selected by chord progression designation switch 20, the chord "Dm" was designated based on the measure number data Dc of the measure counter 22. Then the output data Df of root note detector circuit 16 is "0010" indicating the note D. As it is possible to form the two subordinate notes constituting the m (minor) chord by adding +3 (in binary digits "0011") and +7 (in binary digits "0111") respectively to the note name data of the root note data (refer to table 6), the pattern generating circuit 60 delivers out no signal (the bass pattern data Ds is "0000") at the timing of the first key-on pulse KONP but let the adder 17 deliver "0010", that is, the note name data of D. Then the pattern generation circuit 60 outputs "0011" as the bass pattern data at the timing of the second key-on pulse KONP so as to let the adder 17 deliver out "0101", that is, the note name data of F. It also outputs "0111" as the bass pattern data at the timing of the third key-on pulse KONP so as to let the adder 17 deliver out "1001", that is, note name data of A. In this way, the musical tone signals of the bass tones are produced one after another in accordance with the production timings of the key-on pulses KONP from the tone generator 18.

The pattern generation circuit 60 generates beating pulses PC which determine the production timings of the chord tones. These beating pulses can be obtained, for example, by the similar method as that of production of the above noted key-on pulse KONP. Namely, signals "1" are stored at the memory positions of the memory corresponding to the tone production timings in the rhythm pattern of the chord notes. Stored signal "1" is read out according to an address signal from address generator 24, and then is shaped into a short pulse so as to produce the beating pulse PC. These beating pulses PC are applied to the tone generator 15, and only while the pulses PC exist the chord tones are caused to be produced so that a rhythm is given to the chord tones.

In accordance with the chord progression pattern which is selected by the tonality designation switch 21 and the chord progression designation switch 20, the chord tones are sounded from the sound system 3 in response to the rhythm pattern of the beating pulses PC in every measure. The bass tones are similarly produced from the sound system 3 one after another in accordance with the rhythm pattern of the key-on pulses KONP.

Figure 6:
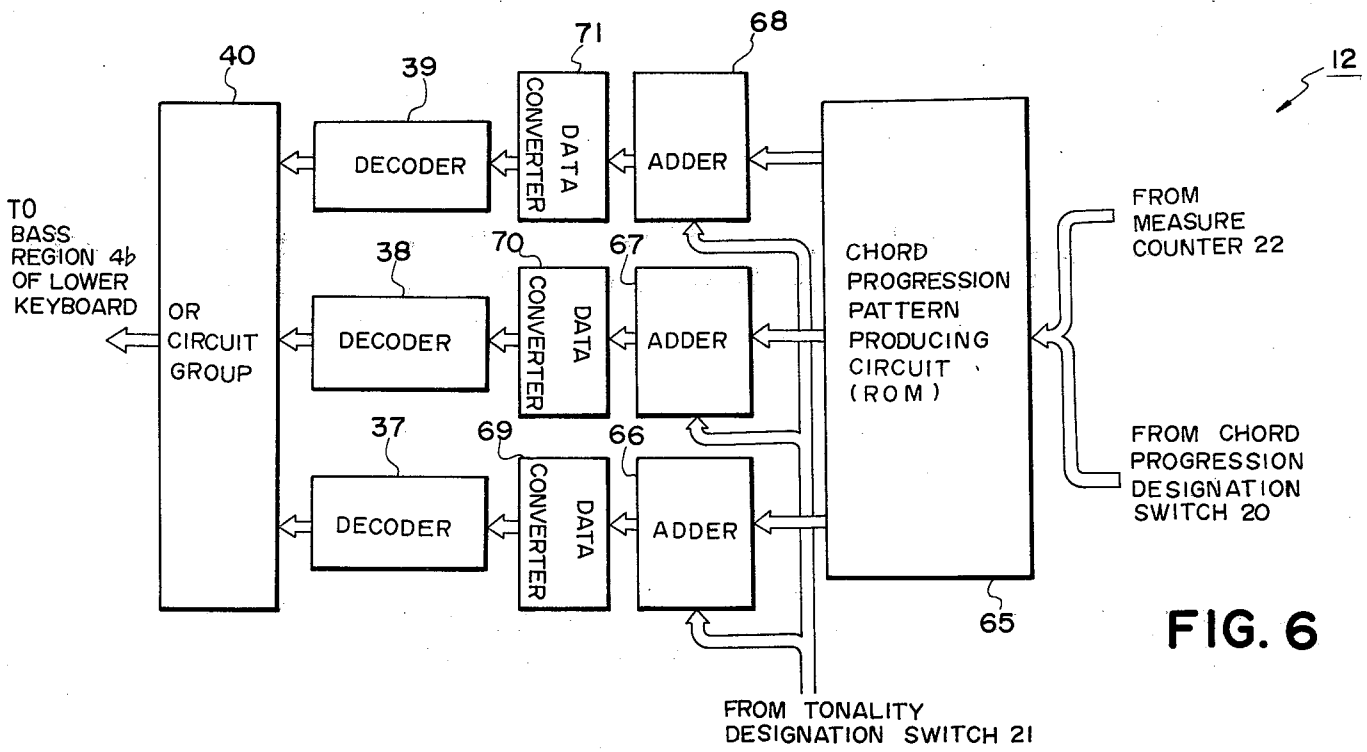
FIG. 6 is a block diagram showing another detailed example of the chord note data producing circuit in FIG. 1.

FIG. 6 shows another example of the chord note data producing circuit 12. In the example in FIG. 3, the note name data of the subordinate notes is produced by adding the tonality data to the degree data of the root note in a scale (chord degree data) so as to produce the note name data of the root note, and then adding this note name data of the root note to numerical values depending on types of the chord to provide the note name data of the chord constituent notes. However, in the example of FIG. 6, three note degree data indicating the degrees of the root note and the subordinate notes of the chord are respectively produced as chord degree data, and thereafter the note name data for the root note and the subordinate notes are produced independently by adding the tonality data (C, C#, etc.) to the respective ones of these note data. In FIG. 6, there are the same common parts as that in FIG. 3 to which the same numbers are assigned (decoders 37–39, OR circuit group 40, etc.).

In FIG. 6, a chord progression pattern producing circuit 65 produces various chord progression patterns (for example, I→VIm→IIm→$V_7$ etc.) in the same way as the chord progression pattern producing circuit 30 in FIG. 3. The progression pattern is selected by the chord progression designation switch 20 and each of the chord degree data (I, VIm etc.) constituting the selected progression pattern is read out in every measure, in accordance with the measure number data Dc from the measure counter 22. However, the manner of reading out the chord degree data is different from that in the example of FIG. 3. In other words, in the FIG. 3 example, the chord degree data (for example, VI) and chord type data (for example, m) were read out. However, in the example of FIG. 6, the chord degree data is read out in a broken up form as three note degree data identifying the root note and two subordinate notes of the chord. For example, where the chord degree data is Im, the three degree data of the notes I, II# and V constituting this chord are read out. Exemplary manners of directly producing these degree data are as described below.

First, the chord degree data (for example, Im) is divided into root note degree data (I) and chord type data (m) as in FIG. 3. The degree data (I) of the root note is outputted directly, but the note degree data (II# and V in the case where the type of the chord is m) of the two subordinate notes are produced by adding numerical values (+3 and +7 in the case where the type of the chord is m) to the note degree data (I) of the root note within the chord progression pattern producing circuit. As another manner, the note degree data of the root note and the subordinate notes of the chord are all stored in advance corresponding to the chord degree to be played so that they have merely to be read out for direct use.

As in the above, the three note degree data of the root note and the subordinate notes produced from the chord progression pattern producing circuit 65 are respectively applied to adders 66–68, where the tonality data from the tonality designation switch 21 is added to these three note degree data so as to change them to the note names. For example, assuming that the chord degree data selected by the chord progression pattern producing circuit 65 is Im, the three degree data outputted from the circuit 65 are I ("0000"), II# ("0011") and V ("0111"). Also assuming that at this time the tonality designated by the tonality designation switch 21 is D (tonality data "0010"), the sum of the tonality data "0010" and each of the note degree data are outputted from the adders 66–68. In other words, the note name data "0010" (corresponding to D note) is outputted from adder 66, the note name data "0101" (corresponding to F note) is outputted from adder 67 and the note name data "1001" (corresponding to the note of A) is outputted from the adder 68. Each of the note name data (data of the chord constituent notes) outputted from the adders 66–68 are respectively inputted to the data converters 69–71. These data converters 69–71 comprise the same circuit as the data converter 32 shown in FIG. 4 and convert the respected sum values as shown in the aforementioned Table 4. Then, the converted note name data are respectively decoded in the decoders 37–39, and the decoded note name signals are passed through the OR circuit group 40, and then, in the same way as in the example of FIG. 3, the note name signals are applied to the bass region **4*b* of the lower keyboard 4. Thereafter, these signals are processed as described before and the produced tone signals are applied to the sound system 3. In the sound system 3**, the chord tones and the bass tones are respectively sounded in accordance with the designated chord progression.

In the above embodiment, a special switch (that is the tonality designation switch 21) is provided in order to designate the tonality. However, a lower keyboard 4 may be designed to have function of the tonality designation. In this case it may be designed as shown in FIG. 7. The output signal (representing the depressed key) in the bass region **4*b* of the lower keyboard 4 is inputted to the encoder 80 and after conversion into the tonality data (Table 2), it is applied to chord note data producing circuit 12. Then, the output signal of this chord note data producing circuit 12 and the output signal of the bass region 4*b* are respectively inputted to the selector 81. The selector 81 operates in response to the output of switch 82 which selects automatic or manual progression of the chords, and when the switch 82 is turned on for selecting "automatic progression of the chords", the output signal of chord note data producing circuit 12 is selected and applied to the tone generator 15 and the root note detector 16. On the other hand, when the switch 82 is turned off for selecting "manual progression of the chord", the output signal of the bass region 4*b* is selected and applied to the tone generator 15 and the root note detector 16. Accordingly, if switch 82 is turned on, it is possible to designate the tonality in the same way as shown in FIG. 1 by the depression of the key in the bass region 4*b* of the lower keyboard 4. Furthermore, by this construction, it is also possible to omit the tonality designation switch 21 of FIG. 1 and also the diodes 10C–10B and the gates 11C–11B in the circuit of the bass region 4*b* of the lower keyboard 4 of FIG. 2**.

As is apparent from the above description, according to this invention, since the chord progression patterns of automatic bass/chord performance are stored in advance and the chord tones are sounded automatically in accordance with the chord progression patterns, it is possible to dispense with the troublesome manual operation of the player.

Furthermore, where the above chord progression pattern is stored in terms of the data before the introduction of the tonality (for example, I→VIm→IIm→$V_7$) as shown in this embodiment, and not directly in terms of the data including the tonality (for example C→Am→Dm→$G_7$), and the tonality (for example, the tonality of C) is designated after reading out the stored data, it becomes permissible to store only the normalized basic patterns of the progression so that the production of the chord tones in all tonalities becomes possible based on one pattern and it is thus also possible to bring about a reduction in the capacity of the memory.

What is claimed is:

1. A system for producing chord progressions automatically in an electronic musical instrument, comprising:

chord progression pattern means for automatically producing, at a certain tempo, consecutive signals each indicative of a constituent chord in a certain prestored chord progression pattern, independent of tonality, and data conversion means, responsive to a tonality designating signal, for converting each of said consecutive chord indicative signals into a set of signals specifying the notes of the corresponding chord and designated tonality, said set of signals being utilized by said electronic musical instrument to produce corresponding tones, whereby a progression of chords is produced automatically with a designatable tonality at said certain tempo.

2. A system according to claim 1 wherein:

said chord progression pattern means produces consecutive signals each containing data designating the chord degree and chord type of the corresponding chord, said chord degree representing the position in the musical scale of the root note of said corresponding chord with respect to a designated tonality, together with tonality selection means for supplying said tonality designating signal, the tonality designated by said signal representing the note name with respect to which said chord degree is correlated, and wherein said data conversion means comprises a first adder means for combining said tonality designating signal with said chord degree designating data to obtain a first signal indicative of the root note of each chord, and additional adder means for combining said root note indicative first signal with said chord type designating data to obtain signals indicative of subordinate notes in said chord.

3. A system according to claim 1 further comprising:

a root note detector associated with said electronic musical instrument for determining the root note of a produced chord, a bass pattern circuit, operative in synchronism with said certain tempo, for producing data designating a pattern of bass notes independent of tonality, and combining means for combining said pattern designating data and said determined root note so as to produce a sequence of bass note control signals utilized by said electronic musical instrument to produce a corresponding sequence of bass notes.

4. An electronic musical instrument comprising:

a memory circuit for storing at least one sequential combination of a plurality of chord data aligned in a certain order representing at least one chord progression pattern, said chord data being expressed in terms of chord degrees independent of tonality, the chord degree representing the position in the musical scale of the chord root note with respect to a separately designated, particular tonality, a read out means for reading out said chord data in sequence from said memory circuit, and an automatic performance means for producing tones based on said read out chord data, said automatic performance means comprising means for designating a tonality to produce tonality data, said designated tonality establishing the particular note name with respect to which said chord degree is correlated, and combining means for combining said tonality data with said chord data.

5. An electronic musical instrument as claimed in claim 4, in which said means for designating the tonality is key switches in a lower keyboard.

6. An electronic musical instrument as claimed in claim 4, in which said chord data comprises first data indicating a chord degree in a musical scale of the designated tonality and second data indicating the type of chord, said combining means including a first circuit for combining said tonality data with said first data so as to produce a note name data of the root note of the chord and a second circuit for combining values representing note degrees of subordinate notes corresponding to said second data with the note name data of the root note so as to produce note name data of the subordinate notes, the note degree representing the separation in the musical scale between the associated subordinate note of a chord and the root note of that chord.

7. An electronic musical instrument as claimed in claim 4, in which said chord data indicates note degrees of respective chord constituent notes, and said combining means is means for combining said tonality data with respective ones of said chord data so as to produce note name data of the tones constituting the chord, the note degree representing the separation in the musical scale between the associated subordinate note of a chord and the root note of that chord.

* * * * *